US008572838B2

(12) United States Patent
Piascik et al.

(10) Patent No.: US 8,572,838 B2
(45) Date of Patent: Nov. 5, 2013

(54) METHODS FOR FABRICATING HIGH TEMPERATURE ELECTROMAGNETIC COIL ASSEMBLIES

(75) Inventors: James Piascik, Morristown, NJ (US); Eric Passman, Morristown, NJ (US); Reza Oboodi, Morristown, NJ (US); Robert Franconi, Morristown, NJ (US); Richard Fox, Morristown, NJ (US); Gary J. Seminara, Morristown, NJ (US); Gene Holden, Morristown, NJ (US); Jacob Harding, Morristown, NJ (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 13/038,838

(22) Filed: Mar. 2, 2011

(65) Prior Publication Data

US 2012/0225784 A1 Sep. 6, 2012

(51) Int. Cl.
*H01F 7/06* (2006.01)

(52) U.S. Cl.
USPC ..... 29/606; 29/602.1; 29/605; 29/832; 336/65; 336/83; 336/176; 336/192; 336/200

(58) Field of Classification Search
USPC ..... 29/594, 602.1, 605, 606, 832, 841, 855, 29/858, 883; 264/272.11; 335/209, 299; 336/65, 83, 176, 192, 200, 206–208, 336/212, 220–222, 229, 232, 233
See application file for complete search history.

(56) References Cited

U.S. PATENT DOCUMENTS

| | | | |
|---|---|---|---|
| 1,722,362 | A | 7/1929 | Wiley |
| 1,742,018 | A | 12/1929 | Wermine |
| 2,262,802 | A | 11/1941 | Hayden |
| 2,787,769 | A | 4/1957 | Hill et la. |
| 2,848,794 | A | 8/1958 | Roth |
| 2,879,361 | A | 3/1959 | Haynman |
| 2,904,619 | A | 9/1959 | Forney, Jr. |
| 2,944,235 | A | 7/1960 | Peters |
| 2,997,647 | A | 8/1961 | Gaugler et al. |

(Continued)

FOREIGN PATENT DOCUMENTS

| | | |
|---|---|---|
| CN | 2529429 | 1/2003 |
| CN | 1174814 C | 11/2004 |

(Continued)

OTHER PUBLICATIONS

R. F. Brazier, "Cables for aircraft. Pressure-type connections." Proceedings of the Institution of Electrical Engineers, Jan. 1, 1967, p. 1307, vol. 114, No. 9.

(Continued)

*Primary Examiner* — Paul D Kim
(74) *Attorney, Agent, or Firm* — Ingrassia Fisher & Lorenz, P.C.

(57) ABSTRACT

Embodiments of a high temperature electromagnetic coil assembly are provided, as are embodiments of a method for fabricating such a high temperature electromagnetic coil assembly. In one embodiment, the method includes the steps of applying a high thermal expansion ceramic coating over an anodized aluminum wire, coiling the coated anodized aluminum wire around a support structure, and curing the high thermal expansion ceramic coating after coiling to produce an electrically insulative, high thermal expansion ceramic body in which the coiled anodized aluminum wire is embedded.

16 Claims, 4 Drawing Sheets

(56) References Cited

U.S. PATENT DOCUMENTS

| | | | | |
|---|---|---|---|---|
| 3,019,403 | A | 1/1962 | Kamm | |
| 3,223,553 | A | 12/1965 | Morey | |
| 3,256,417 | A | 6/1966 | Merrett | |
| 3,308,411 | A | 3/1967 | Roshala | |
| 3,308,414 | A | 3/1967 | Ostrander et al. | |
| 3,336,553 | A | 8/1967 | Cripps | |
| 3,352,009 | A | 11/1967 | Cohn et al. | |
| 3,373,390 | A | 3/1968 | Rechel | |
| 3,542,276 | A | 11/1970 | James | |
| 3,688,397 | A | 9/1972 | Cleaver et al. | |
| 3,694,785 | A | 9/1972 | Chass | |
| 3,731,368 | A | 5/1973 | Dieteman et al. | |
| 3,775,628 | A | 11/1973 | Andersson et al. | |
| 3,812,580 | A | 5/1974 | Drugmand | |
| 3,862,416 | A | 1/1975 | Phillips et al. | |
| 3,881,163 | A | 4/1975 | Lindroth et al. | |
| 3,932,928 | A | 1/1976 | King | |
| 3,961,151 | A * | 6/1976 | Danner | 219/619 |
| 4,056,883 | A | 11/1977 | Danner | |
| 4,057,187 | A | 11/1977 | Cranston et al. | |
| 4,107,635 | A | 8/1978 | Brundage et al. | |
| 4,135,296 | A | 1/1979 | Kami et al. | |
| 4,196,510 | A | 4/1980 | Gudmestad et al. | |
| 4,258,347 | A * | 3/1981 | Konig | 335/282 |
| 4,376,904 | A | 3/1983 | Horrigan | |
| 4,388,371 | A | 6/1983 | Bolon et al. | |
| 4,429,007 | A | 1/1984 | Bich et al. | |
| 4,445,103 | A | 4/1984 | Chass | |
| 4,476,192 | A | 10/1984 | Imai et al. | |
| 4,524,624 | A | 6/1985 | Di Noia et al. | |
| 4,554,730 | A | 11/1985 | Westervelt et al. | |
| 4,621,251 | A | 11/1986 | Keefe | |
| 4,641,911 | A | 2/1987 | Pavlak et al. | |
| 4,786,760 | A | 11/1988 | Friedhelm | |
| 4,866,573 | A | 9/1989 | Bernstein | |
| 4,870,308 | A | 9/1989 | Sismour, Jr. | |
| 4,950,438 | A | 8/1990 | Nakamura et al. | |
| 5,091,609 | A | 2/1992 | Sawada et al. | |
| 5,105,531 | A | 4/1992 | Sawada et al. | |
| 5,122,506 | A | 6/1992 | Wang | |
| 5,140,292 | A | 8/1992 | Aronow | |
| 5,211,789 | A | 5/1993 | Christian et al. | |
| 5,226,220 | A | 7/1993 | Gevas et al. | |
| 5,460,503 | A | 10/1995 | Kitajima et al. | |
| 5,475,203 | A * | 12/1995 | McGaffigan | 219/548 |
| 5,493,159 | A | 2/1996 | Norris | |
| 5,497,936 | A | 3/1996 | Vojta et al. | |
| 5,636,434 | A | 6/1997 | Okey et al. | |
| 5,666,099 | A | 9/1997 | Ostrem | |
| 5,675,891 | A | 10/1997 | Childs et al. | |
| 5,693,208 | A | 12/1997 | Paulet | |
| 5,815,091 | A | 9/1998 | Dames et al. | |
| 5,833,825 | A | 11/1998 | Otten et al. | |
| 6,009,141 | A | 12/1999 | Hell et al. | |
| 6,038,760 | A | 3/2000 | Antoine et al. | |
| 6,189,202 | B1 | 2/2001 | Masuda et al. | |
| 6,261,437 | B1 | 7/2001 | Hernnaes et al. | |
| 6,368,485 | B1 | 4/2002 | Ue et al. | |
| 6,750,749 | B2 | 6/2004 | Shirahata et al. | |
| 6,847,145 | B2 | 1/2005 | Van Dine et al. | |
| 6,909,279 | B2 | 6/2005 | Niwa | |
| 6,927,666 | B2 | 8/2005 | Ahn et al. | |
| 6,976,308 | B2 | 12/2005 | Jonli | |
| 7,129,605 | B2 | 10/2006 | Zhang et al. | |
| 7,147,500 | B2 | 12/2006 | Tabata et al. | |
| 7,147,929 | B2 | 12/2006 | Amagi et al. | |
| 7,365,627 | B2 | 4/2008 | Yen et al. | |
| 7,394,022 | B2 | 7/2008 | Gumley | |
| 7,459,817 | B2 | 12/2008 | VanLuik et al. | |
| 7,513,029 | B2 | 4/2009 | Ortt et al. | |
| 7,572,980 | B2 | 8/2009 | Elie et al. | |
| 7,588,530 | B2 | 9/2009 | Heilman et al. | |
| 7,705,265 | B2 | 4/2010 | Asakura et al. | |
| 7,795,538 | B2 | 9/2010 | Kaiser et al. | |
| 7,893,583 | B2 | 2/2011 | Du et la. | |
| 7,947,905 | B2 | 5/2011 | Pasini | |
| 8,128,441 | B2 | 3/2012 | Mukuno | |
| 8,253,299 | B1 | 8/2012 | Rittenhouse | |
| 2003/0010813 | A1 | 1/2003 | Nakaya | |
| 2003/0020344 | A1 | 1/2003 | Futami et al. | |
| 2003/0074884 | A1 | 4/2003 | Snow et al. | |
| 2004/0010908 | A1 | 1/2004 | Kobayashi | |
| 2004/0140293 | A1 | 7/2004 | Kohama et al. | |
| 2004/0158981 | A1 | 8/2004 | Antaya et al. | |
| 2005/0012423 | A1 | 1/2005 | Yasuhara et al. | |
| 2005/0127774 | A1 | 6/2005 | Sogabe et al. | |
| 2007/0279047 | A1 | 12/2007 | Schumacher | |
| 2008/0007134 | A1 | 1/2008 | Shimura et al. | |
| 2009/0121896 | A1 * | 5/2009 | Mitchell et al. | 340/870.31 |
| 2009/0206974 | A1 | 8/2009 | Meinke | |
| 2009/0255319 | A1 | 10/2009 | Sokol | |
| 2009/0273254 | A1 | 11/2009 | Heim | |
| 2009/0325809 | A1 | 12/2009 | Hong et al. | |
| 2010/0018768 | A1 | 1/2010 | Takahashi et al. | |
| 2010/0031497 | A1 | 2/2010 | Saka et al. | |
| 2010/0176683 | A1 | 7/2010 | Waddell et al. | |
| 2010/0189884 | A1 | 7/2010 | Kaiser et al. | |
| 2011/0054584 | A1 | 3/2011 | Alexander et al. | |
| 2011/0192451 | A1 | 8/2011 | Sato et al. | |
| 2012/0126642 | A1 | 5/2012 | Miyamoto et al. | |
| 2012/0169174 | A1 | 7/2012 | Radov et al. | |
| 2012/0175991 | A1 | 7/2012 | Tassinario et al. | |

FOREIGN PATENT DOCUMENTS

| | | | |
|---|---|---|---|
| DE | 3830740 | A1 | 3/1990 |
| DE | 102007034322 | A1 | 1/2009 |
| DE | 102010001888 | A1 | 8/2010 |
| EP | 0012422 | A1 | 6/1980 |
| EP | 0886053 | A2 | 12/1998 |
| FR | 2903246 | A1 | 1/2008 |
| GB | 147786 | | 4/1921 |
| GB | 569196 | | 5/1945 |
| GB | 719126 | A | 11/1954 |
| JP | 2005183554 | A | 7/2005 |
| JP | 2008288512 | A | 11/2008 |
| JP | 2012-105392 | | 5/2012 |

OTHER PUBLICATIONS

EPO, European Extended Search Report for Application No. 12175199.4, dated Oct. 17, 2012.

Chaklader, et al.; Alumina fibre from aluminium wire, ScienceDirect.com—Composites—Alumina fibre from aluminium wire; retrieved from Internet http://www.sciencedirect.com/science/article/pii/0010436181900173.

USPTO Office Action for U.S. Appl. No. 13/187,359, dated Jan. 30, 2013.

USPTO Notice of Allowance for U.S. Appl. No. 13/187,359, dated Apr. 2, 2013.

* cited by examiner

METHODS FOR FABRICATING HIGH TEMPERATURE ELECTROMAGNETIC COIL ASSEMBLIES

TECHNICAL FIELD

The present invention relates generally to high temperature coiled-wire devices and, more particularly, to high temperature electromagnetic coil assemblies for usage within coiled-wire devices, as well as to methods for the production of high temperature electromagnetic coil assemblies.

BACKGROUND

There is an ongoing demand in the aerospace industry for low cost electromagnetic coils suitable for usage in coiled-wire devices, such as actuators (e.g., solenoids) and sensors (e.g., linear variable differential transformers), capable of providing prolonged and reliable operation in high temperature environments and, specifically, while subjected to temperatures in excess of 260° C. It is known that low cost electromagnetic coils can be produced utilizing aluminum wire, which is commercially available at minimal cost, which provides excellent conductive properties, and which can be anodized to form an insulative alumina shell over the wire's outer surface. However, the outer alumina shell of anodized aluminum wire is relatively thin and can easily abrade due to contact between neighboring coils during winding. As a result, bare anodized aluminum wire is prone to shorting during the coiling process. Coil-to-coil abrasion can be greatly reduced or eliminated by utilizing anodized aluminum wires having insulative organic-based (e.g., polyimide) coatings to form the electromagnetic coil; however, organic materials rapidly decompose, become brittle, and ultimately fail when subjected to temperatures exceeding approximately 260° C.

A limited number of ceramic insulated wires are commercially available, which can provide continuous operation at temperatures exceeding 260° C.; however, such wires tend to be prohibitively costly for most applications and may contain an undesirably high amount of lead. High temperature wires are also available that employ cores fabricated from non-aluminum metals, such as silver, nickel, and copper. However, wires having non-aluminum cores tend to be considerably more costly than aluminum wire and may be incapable of forming an insulative oxide shell. In addition, wires formed from nickel tend to be less conductive than is aluminum wire and, consequently, add undesired bulk and weight to an electromagnetic coil assembly utilized within avionic applications. Finally, while insulated wires having cores fabricated from a first metal (e.g., copper) and claddings formed from a second meal (e.g., nickel) are also known, such wires are relatively costly, which tend to become less conductive over time due to diffusion of the cladding material into the wire's core, and may exhibit alloying-induced resistance creeping when exposed to elevated temperatures for longer periods of time. Additionally, wires employing metal-clad conductors still require electrically-insulative coatings of the type described above.

Considering the above, there exists an ongoing need to provide embodiments of a electromagnetic coil assembly suitable for usage within high temperature coiled-wire devices (e.g., solenoids, linear variable differential transformers, and three wire position sensors, to list but a few) utilized within avionic applications and other high temperature applications. Ideally, embodiments of such a high temperature electromagnetic coil assembly would be relatively inexpensive to produce, relatively compact and lightweight, and capable of reliable and continual operation when subjected to temperatures in excess of 260° C. It would also be desirable to provide embodiments of a method for fabricating such a high temperature electromagnetic coil assembly. Other desirable features and characteristics of the present invention will become apparent from the subsequent Detailed Description and the appended Claims, taken in conjunction with the accompanying Drawings and the foregoing Background.

BRIEF SUMMARY

Embodiments of a high temperature electromagnetic coil assembly are provided, as are embodiments of a method for fabricating such a high temperature electromagnetic coil assembly. In one embodiment, the method includes the steps of applying a high thermal expansion ceramic coating over an anodized aluminum wire, coiling the coated anodized aluminum wire around a support structure, and curing the high thermal expansion ceramic coating after coiling to produce an electrically insulative, high thermal expansion ceramic body in which the coiled anodized aluminum wire is embedded.

Embodiments of a high temperature electromagnetic coil assembly are further provided. In one embodiment, the high temperature electromagnetic coil assembly includes a support structure, an anodized aluminum wire wound around the support structure, and an electrically-insulative, high thermal expansion body formed around the support structure and in which the anodized aluminum wire is embedded. The electrically-insulative, high thermal expansion body electrically insulates the coils of the anodized aluminum wire to reduce the probability of electrical shorting and to increase the breakdown voltage of the anodized aluminum wire during high temperature operation of the high temperature electromagnetic coil assembly.

BRIEF DESCRIPTION OF THE DRAWINGS

At least one example of the present invention will hereinafter be described in conjunction with the following figures, wherein like numerals denote like elements, and.

DETAILED DESCRIPTION

The following Detailed Description is merely exemplary in nature and is not intended to limit the invention or the application and uses of the invention. Furthermore, there is no intention to be bound by any theory presented in the preceding Background or the following Detailed Description.

Figure 1:
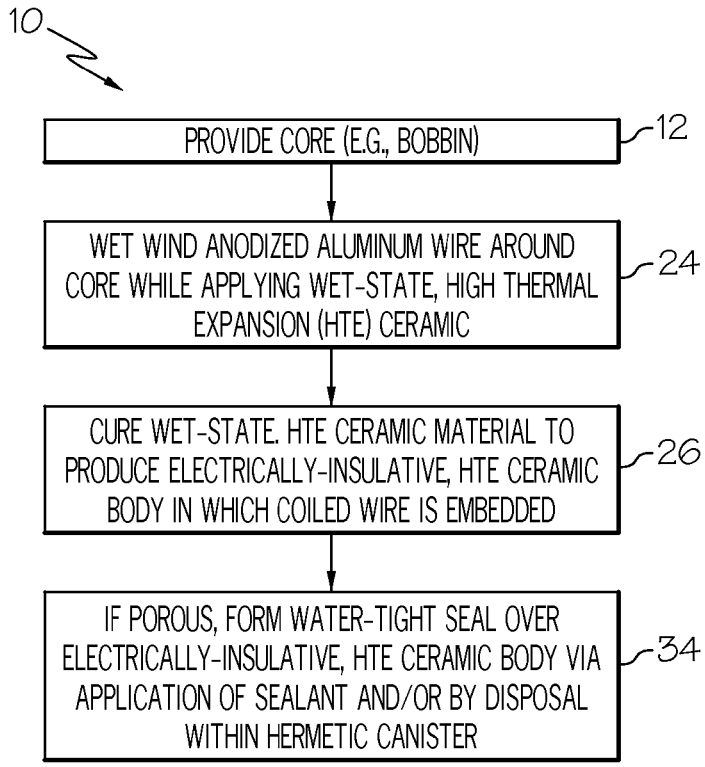
FIG. 1 is a flowchart illustrating a method for producing a high temperature electromagnetic coil assembly in accordance with an exemplary embodiment of the present invention.
Figure 2:
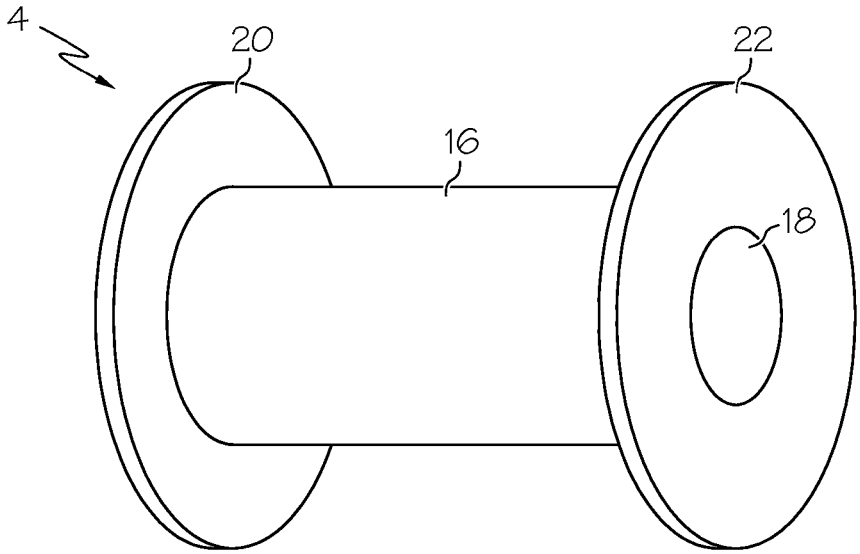
FIG. 2 is an isometric view of an exemplary bobbin around which anodized aluminum wire can be wound in accordance with an exemplary implementation of the method illustrated in FIG. 1.

FIG. 1 is a flowchart illustrating a method 10 for producing a high temperature electromagnetic coil assembly in accordance with an exemplary embodiment of the present invention. To commence exemplary method 10 (STEP 12), a support structure is obtained from a supplier or fabricated by, for example, machining of a block of substantially non-ferromagnetic material, such as aluminum, certain 300 series stainless steels, or ceramic. As appearing herein, the term "support structure" denotes any structural element or assemblage of structural elements around which an anodized aluminum wire can be wound to form one or more electromagnetic coils, as described below. The support structure provided during STEP 12 of exemplary method 10 will often assume the form of a hollow spool or bobbin, such as bobbin 14 shown in FIG. 2. With reference to FIG. 2, bobbin 14 includes an elongated tubular body 16, a central channel 18 extending through body 16, and first and second flanges 20 and 22 extending radially outward from first and second opposing ends of body 16, respectively. Although not shown in FIG. 2 for clarity, an outer insulative shell may be formed over the outer surface of bobbin 14 or an outer insulative coating may be deposited over the outer surface of bobbin 14. For example, in embodiments wherein bobbin 14 is fabricated from a stainless steel, bobbin 14 may be coated with an outer dielectric (e.g., glass) coating utilizing, for example, a brushing process. Alternatively, in embodiments wherein bobbin 14 is fabricated from an aluminum, bobbin 14 may be anodized to form an insulative alumina shell over the outer surface of bobbin 14.

Next, at STEP 24 of method 10 (FIG. 1), an anodized aluminum wire is wet wound around the support structure (e.g., bobbin 14 shown in FIG. 2) while a high thermal expansion ("HTE") ceramic material is applied over the wire's outer surface in a wet or flowable state to form a viscous coating thereon. The ceramic material is, by definition, an inorganic and non-metallic material, whether crystalline or amorphous. As will be described below in conjunction with STEP 26 of exemplary method 10 (FIG. 1), the wet-state, HTE ceramic material is subsequently dried and cured to produce an electrically-insulative, high thermal expansion ceramic body in which the coiled anodized aluminum wire is embedded. The phrase "wet-state," as appearing herein, denotes a ceramic material carried by (e.g., dissolved within) or containing a sufficient quantity of liquid to be applied over the anodized aluminum wire in real-time during a wet winding process by brushing, spraying, or similar technique. For example, in the wet-state, the ceramic material may assume the form of a pre-cure (e.g., water-activated) cement or a plurality of ceramic (e.g., low melt glass) particles dissolved in a solvent, such as a high molecular weight alcohol, to form a slurry or paste. As appearing herein, the phrase "high thermal expansion ceramic body" and the phrase "HTE ceramic body" are each utilized to denote a ceramic body or coherent having a coefficient of thermal expansion exceeding approximately 10 parts per million per degree Celsius ("ppm per ° C."). Similarly, the phrase "high thermal expansion ceramic material" and the phrase "HTE ceramic material" each denote a ceramic material that can be cured or fired to produce a high thermal expansion ceramic body, as previously defined. The significance of selecting a ceramic material that can be applied to an outer surface of anodized aluminum wire in a wet state and subsequently cured to produce a solid, electrically-insulative, ceramic body having a coefficient of thermal expansion exceeding approximately 10 ppm per ° C. will be described in detail below.

During STEP 24 of method 10 (FIG. 1), winding of the anodized aluminum wire may be carried-out utilizing a conventional wire winding machine. As noted above, application of the wet-state, HTE ceramic material over the anodized aluminum wire during winding is conveniently accomplished by brushing, spraying, or a similar technique. In a preferred embodiment, the HTE ceramic material is continually applied over the full width of the anodized aluminum wire to the entry point of the coil such that the puddle of liquid is formed through which the existing wire coils continually pass during rotation. The wire may be slowly turned during application of the HTE ceramic material by, for example, a rotating apparatus or wire winding machine, and a relatively thick layer of HTE ceramic material may be continually brushed onto the wire's surface to ensure that a sufficient quantity of the ceramic material is present to fill the space between neighboring coils and multiple layers of the anodized aluminum wire. In larger scale production, application of the HTE ceramic material to the anodized aluminum wire may be performed by a pad, brush, or automated dispenser, which dispenses a controlled amount of the HTE ceramic material over the wire during winding.

After winding of the anodized aluminum wire and application of the wet-state, HTE ceramic material (STEP 24, FIG. 1), the ceramic material is dried and cured to produce an electrically-insulative, water insoluble, high thermal expansion ceramic body or composite mass in which the coiled anodized aluminum wire is embedded (STEP 26, FIG. 1). As appearing herein, the term "curing" denotes exposing the wet-state, HTE ceramic material to process conditions (e.g., temperatures) sufficient to transform the wet-state, HTE ceramic material into a solid or near-solid ceramic body, whether by chemical reaction or by melting of particles. The term "curing" is thus defined to include firing of, for example, low melt glasses. In most cases, curing of the HTE ceramic material will involve thermal cycling over a relatively wide temperature range, which will typically entail exposure to elevated temperatures well exceeding room temperatures (e.g., about 20-25° C.), but less than the melting point of the anodized aluminum wire (approximately 660° C.). However, in embodiments wherein the HTE ceramic material is an inorganic cement curable at or near room temperature, curing may be performed at correspondingly low temperatures. In preferred embodiments, curing is performed at temperatures up to the expected operating temperatures of the high temperature electromagnetic coil assembly, which may approach or exceed approximately 315° C.

To ensure compatibility with the anodized aluminum wire, and to ensure maintenance of the structural and insulative integrity of the electromagnetic coil assembly through aggressive and repeated thermal cycling, the HTE ceramic material is selected to have several specific properties. These properties include: (i) the ability to produce, upon curing, a ceramic body that provides mechanical isolation, position holding, and electrical insulation between neighboring coils of the anodized aluminum wire through the operative temperature range of the electromagnetic coil assembly; (ii) the ability to produce, upon curing, a ceramic body capable of withstanding significant mechanical stress without structural compromise during thermal cycling; (iii) the ability to prevent significant movement of the anodized aluminum wire coils during wet winding and, in certain embodiments, during subsequent heat treatment (e.g., during melting of low melt glass particles, as described more fully below); (iv) the ability to be applied to the anodized aluminum wire in a wet state during the winding process at temperatures below the melting point of the anodized aluminum wire (again, approximately 660° C.); and (v) the ability to harden (e.g., by curing or firing) into a solid state or near-solid state at temperatures lower than the melting point of the anodized aluminum wire.

In addition to the above-listed criteria, it is also desired for the selected electrically-insulative, HTE ceramic material to produce, upon curing, a ceramic body having a coefficient of thermal expansion falling within a specific range. By definition, the electrically-insulative, HTE ceramic body has a coefficient of thermal expansion ("CTE") exceeding approximately 10 ppm per ° C. By comparison, the CTE of anodized aluminum wire is approximately 23 ppm per ° C. By selecting the HTE ceramic material to have a CTE exceeding approximately 10 ppm per ° C., and therefore more closely matched to the CTE of the anodized aluminum wire, relative movement and mechanical stress between cured HTE ceramic body and the anodized aluminum wire can be reduced during thermal cycling and the likelihood of structural damage to the ceramic body or to the wire (e.g., breakage due to stretching) can be minimized. Stated differently, by forming the high thermal expansion ceramic body from a material having a coefficient of thermal expansion substantially matched to that of the anodized aluminum wire, thermal mismatch between the ceramic body and the anodized aluminum wire is minimized resulting in a significant reduction in the mechanical stress exerted on the ceramic body and the wire through thermal cycling of the high temperature electromagnetic coil assembly.

The ability of the cured HTE ceramic body to withstand mechanical stress induced by thermal cycling is also enhanced, in certain embodiments, by forming the HTE ceramic body from an inorganic cement having a relatively high porosity, as described more fully below. In a similar regard, it is also desirable to form bobbin 14 and the bobbin's dielectric coating from materials having coefficients of thermal expansion similar to that of anodized aluminum wire. While selecting the electrically-insulative, HTE ceramic body to have a CTE approaching that of the anodized aluminum wire is advantageous, it is generally preferred that the CTE of the HTE ceramic body does not exceed the CTE of the anodized aluminum wire. In this manner, it can be ensured that the HTE ceramic body is subjected to compressive stress, rather than tensile stress, during thermal cycling of the high temperature electromagnetic coil assembly thereby further reducing the likelihood of fracture and spalling of the HTE ceramic body. For the foregoing reasons, the HTE ceramic body is preferably selected to have a coefficient of thermal expansion between approximately 10 and approximately 23 ppm per ° C. and, more preferably, between approximately 16 and approximately 23 ppm per ° C.

In a first group of embodiments, the electrically-insulative, HTE ceramic material applied to the anodized aluminum wire during STEP 24 comprises a mixture of at least a low melt glass and a particulate filler material. As defined herein, the term "low melt glass" denotes a glass or glass mixture having a melting point less than the melting point of the anodized aluminum wire. Low melt glasses having coefficients of thermal expansion exceeding approximately 10 ppm per ° C. include, but are not limited to, leaded borosilicates glasses. Commercially available leaded borosilicate glasses include 5635, 5642, and 5650 series glasses having processing temperatures ranging from approximately 350° C. to approximately 550° C. and available from KOARTAN™ Microelectronic Interconnect Materials, Inc., headquartered in Randolph, N.J. During STEP 24 (FIG. 1), the low melt glass is conveniently applied as a paste or slurry, which may be formulated from ground particles of the low melt glass, the particulate filler material, a solvent, and a binder. In a preferred embodiment, the solvent is a high molecular weight alcohol resistant to evaporation at room temperature, such as alpha-terpineol or TEXINOL®; and the binder is ethyl cellulose, an acrylic, or similar material.

It is desirable to include a particulate filler material in the embodiments wherein the electrically-insulative, HTE ceramic material comprises a low melt glass to prevent relevant movement and physical contact between neighboring coils of the anodized aluminum wire during coiling and firing processes. Although the filler material may comprise any particulate material suitable for this purpose (e.g., zirconium or aluminum powder), binder materials having particles generally characterized by thin, sheet-like shapes (commonly referred to as "platelets" or "laminae") have been found to better maintain relative positioning between neighboring coils as such particles are less likely to dislodge from between two adjacent turns or layers of the wire's cured outer surface than are spherical particles. Examples of suitable binder materials having thin, sheet-like particles include mica and vermiculite. As indicated above, the low melt glass may be applied to the anodized aluminum wire by brushing immediately prior to the location at which the wire is being coiled around the support structure. Subsequently, during STEP 26 of exemplary method 10 (FIG. 1), the low melt glass may be fired at temperatures greater than the melting point of the glass, but less than the melting point of the anodized aluminum wire. During firing of the low melt glass, the filler material dispersed throughout the glass generally prevents relative movement and contact between neighboring coils of the anodized aluminum wire.

In a second group of embodiments, the ceramic body is formed from a high thermal expansion, electrically-insulative, inorganic cement, which may undergo a chemical or thermal curing process to set the inorganic cement into the solid, electrically-insulative body. As one example, a water-activated, silicate-based cement can be utilized, such as the sealing cement bearing Product No. 33S and commercially available from the SAUEREISEN® Cements Company, Inc., headquartered in Pittsburgh, Pa. As was the case previously, the water-activated cement may be continuously applied to the anodized aluminum wire via a brush just ahead of the location at which the wire is wound around the support structure. A relatively thin layer of cement is preferably applied, while ensuring that ample cement is available for filling the space between adjacent coils and winding layers. After winding, the cement may be allowed to air dry or heated to a temperature less than the boiling point of water to evaporate excess water from the cement, and the entire assembly may then be heat treated to thermally cure the cement in the above-described manner (STEP 26, FIG. 1).

While, as indicated in FIG. 1 at STEP 24, the high thermal expansion ceramic material is preferably applied to the anodized aluminum wire during a wet winding process, this is not always necessary. For example, in embodiments wherein the HTE ceramic material contains a low melt glass and preferably also a particulate filler material of the type described above, the HTE ceramic material may be applied to the anodized aluminum wire prior to winding as, for example, a paint, and subsequently allowed to dry to form a coating over the unwound anodized aluminum wire. The coated anodized aluminum wire may then be dry wound in the above-described manner and subsequently fired to melt the glass particles and thereby form an electrically-insulative, high thermal expansion body in which the anodized aluminum wire is embedded. As a second example, in embodiments wherein the HTE ceramic material contains a low melt glass, the HTE ceramic material may be applied to the anodized aluminum wire after winding utilizing, for example, a vacuum infiltration process. The entire assembly may then be fired to melt the low melt glass particles and form the electrically-insulative, high thermal expansion body, as previously described. In this case, the anodized aluminum wire may initially be coated with the particulate filler material prior to winding and prior to vacuum infiltration of the wire coils with the low melt glass to prevent wire-to-wire contact during winding.

Figure 3:
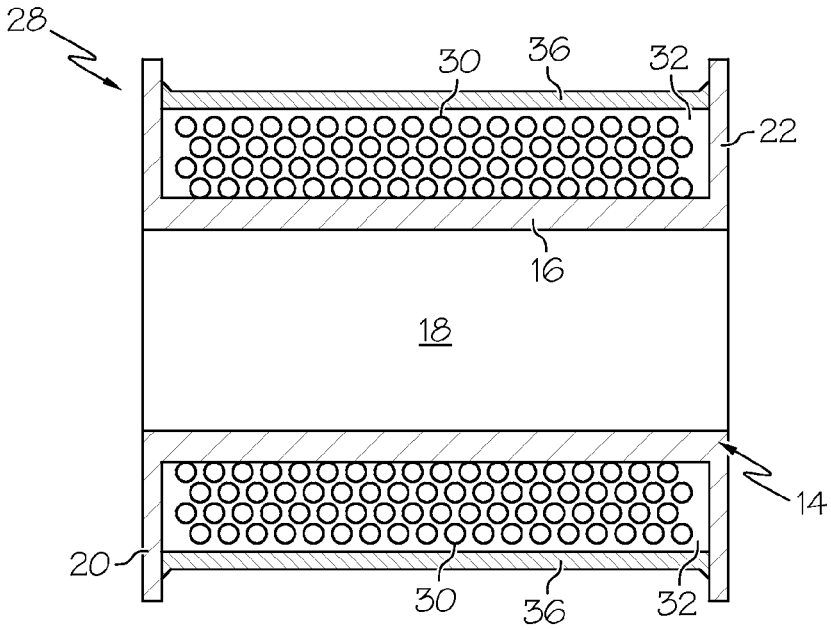
FIG. 3 is a cross-sectional view of an electromagnetic coil assembly produced in accordance with the exemplary method illustrated in FIG. 1.

FIG. 3 is a cross-sectional of an electromagnetic coil assembly 28 that may be produced pursuant to STEP 26 of exemplary method 10 (FIG. 1) in certain embodiments. As can be seen in FIG. 3, electromagnetic coil assembly 28 includes an anodized aluminum wire 30, which has been wound around bobbin 14 to form a plurality of multi-turn coils. The coils of anodized aluminum wire 30 are embedded in or suspended in an electrically-insulative, high thermal expansion ceramic body 32, which is formed around elongated body 16 and which extends between opposing flanges 22 and 24 of bobbin 14. Electrically-insulative, HTE ceramic body 32 provides electrical insulation between neighboring coils of wire 30 and increases the overall structural integrity of electromagnetic coil assembly 10. In view of its composition, ceramic body 32 maintains its insulative integrity even when exposed to temperatures well in excess of temperatures at which organic-based insulative materials breakdown and fail (e.g., temperatures approaching or exceeding 260° F.). In so doing, ceramic body 32 reduces the likelihood of electrical shortage during operation of high temperature coil assembly 10 and increases the breakdown voltage of anodized aluminum wire 30. Furthermore, by providing physical separation and electrical insulation between neighboring coils of wire 30, ceramic body 32 enables wire 30 to be formed from anodized aluminum, which provides excellent conductivity and is commercially available at a fraction of the cost of wires formed from other metals (e.g., nickel, silver, or copper) or combinations of metals (e.g., nickel-clad copper). The excellent conductivity of anodized aluminum wire 30 also enables the dimensions and weight of high temperature coil assembly 10 to be minimized, which is especially advantageous in the context of avionic applications. As a further advantage, the outer alumina shell of anodized aluminum wire 30 provides additional electrical insulation between neighboring coils of wire 30 to further reduce the likelihood of shorting and breakdown voltage during operation of high temperature electromagnetic coil assembly 28.

In embodiments wherein the HTE ceramic body is formed from a material that is not susceptible to the ingress of water (e.g., when HTE ceramic body is formed from a non-porous glass), exemplary method 10 may conclude after STEP 26 (FIG. 1). However, in embodiments wherein the HTE ceramic body is formed from a material susceptible to water intake, such as a porous inorganic cement, one or more sealing steps may be performed after STEP 26 (FIG. 1) to form a water-tight seal over the ceramic body. For example, as indicated in FIG. 1 at STEP 34, a liquid sealant may be applied over an outer surface of the electrically-insulative, HTE ceramic body to encapsulate the ceramic body. Suitable sealants include, but are limited to, waterglass and low melting (e.g., lead borosilicate) glass materials of the type described above. Furthermore, in certain embodiments, a sol-gel process can be utilized to deposit ceramic materials in particulate form over the outer surface of the electrically insulative, HTE ceramic body, which may be subsequently heated, allowed to cool, and solidify to form a dense water-impenetrable coating over the ceramic body. It should be noted, however, that, in embodiments wherein the ceramic body is formed from a porous cement, it is undesirable for the sealant to infiltrate deeply into the pores of the electrically-insulative, HTE cement body and thereby densify the cement body as this can aversely affect the ability of the cement body to absorb mechanical stress during thermal cycling without fracture and spalling. Thus, in embodiments wherein the electrically-insulative, HTE ceramic body is formed from a porous cement and a sealant is applied over the over surface of the ceramic or cement body, it is preferred that only a relatively thin layer of sealant is applied over the ceramic body, as generally illustrated in FIG. 3 at 36.

Figure 4:
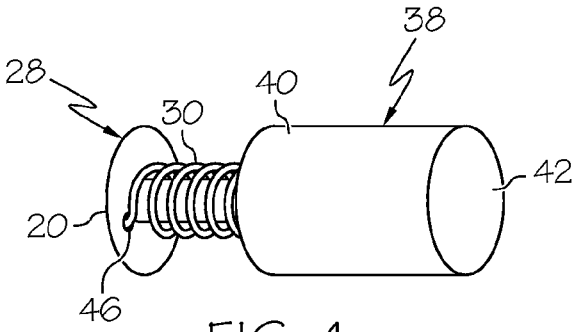
FIGS. 4-6 are simplified isometric views illustrating one manner in which the electromagnetic coil assembly shown in FIG. 3 may be sealed within a hermetic canister in accordance with certain implementations of the exemplary method shown in FIG. 1.
Figure 5:
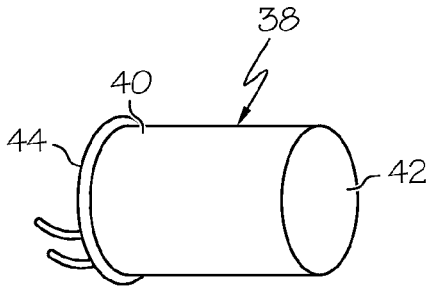

In addition to or in lieu of application of a liquid sealant, a water-tight seal may also be formed over the electrically-insulative HTE ceramic body by packaging the electromagnetic coil assembly within a hermetically-sealed container or canister. For example, as shown in FIG. 4, electromagnetic coil assembly 28 may be inserted into a canister 38 having an open end 40 and a closed end 42 (HTE ceramic body 32 and glass sealant 36 are not shown in FIG. 4 for clarity). The cavity of canister 38 may be generally conformal with the geometry and dimensions of electromagnetic coil assembly 28 such that, when fully inserted into canister 38, trailing flange 20 effectively plugs or covers open end 40 of canister 38. As shown in FIG. 5, a circumferential weld or seal 44 may then be formed along the interface defined by trailing flange 20 and open end 40 of canister 38 to hermetically seal canister 38. As indicated in FIG. 4, a pair of feedthroughs 46 (e.g., conductive terminal pins extending through a glass body, a ceramic body, or other insulating structure) may be mounted through trailing flange 20 to enable electrical connection to electromagnetic coil assembly 28 while persevering the hermetically-sealed nature of canister 38. In further embodiments, feedthroughs may instead be provided through the annular sidewall or closed end 42 of canister 38 to permit electrical connection to electromagnetic coil assembly 28.

Figure 6:
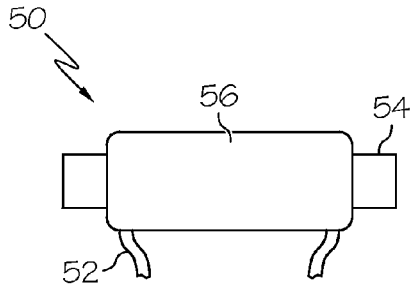
Figure 7:
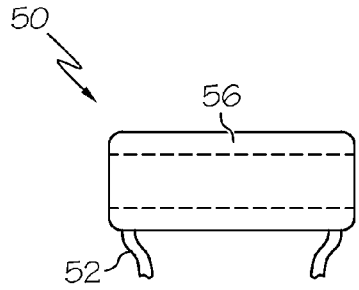
FIGS. 7-9 are simplified isometric views illustrating one manner in which an electromagnetic coil assembly can be initially wound around a temporary support structure, removed, and subsequently installed onto a permanent support structure in accordance with further implementations of the exemplary method shown in FIG. 1.
Figure 8:
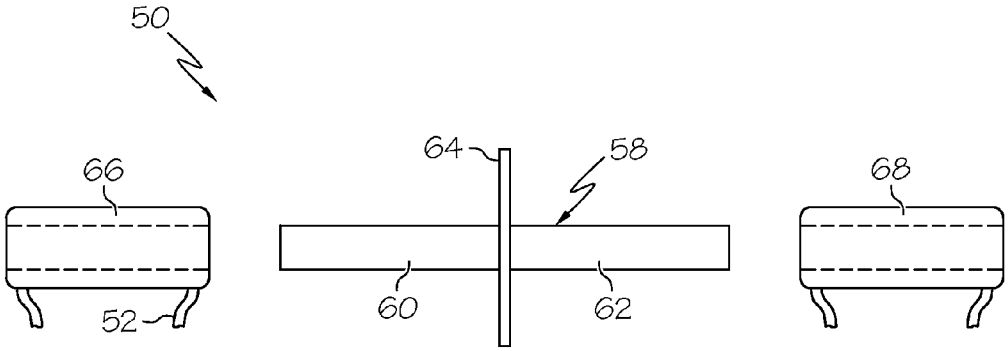
Figure 9:
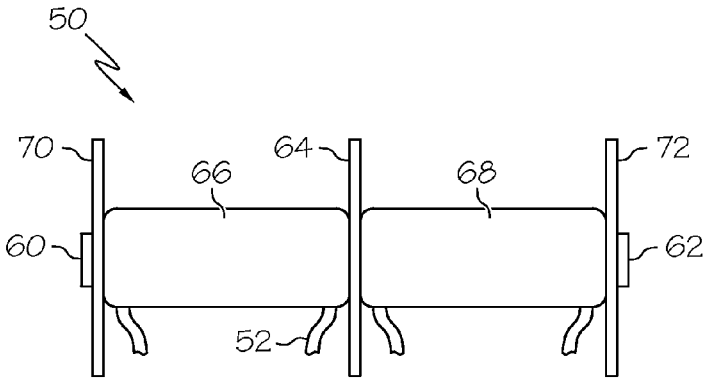

In many implementations of exemplary method 10 (FIG. 1), the support structure around which the anodized aluminum wire is wound will be a permanent support structure. However, this need not always be the case. In certain implementations of method 10 (FIG. 1), the support structure around which the anodized aluminum wire may be a temporary support structure, which is removed after curing of the HTE ceramic material. This may be more fully appreciated by referring FIGS. 7-9, which illustrate a second exemplary high temperature electromagnetic coil assembly 50 at various stages of manufacture during a further implementation of exemplary method 10 (FIG. 1). Referring initially to FIG. 6, an anodized aluminum wire 52 is wound around a temporary support structure 54, and a wet-state, HTE ceramic material is applied over the wire's outer surface. As noted above, the wet-state, HTE ceramic material is preferably applied over wire 52 during a wet winding process by, for example, brushing. The wet-state, HTE ceramic material is then cured by, for example, subjecting the entire assembly to thermal cycling to form a solid, electrically-insulative, ceramic body 56 in which the aluminum wire 52 is embedded. As indicated in FIG. 7, the potted coil is then removed from temporary support structure 54, which may be coated with a non-stick material, such as Telfon®, to facilitate support structure removal. Next, as illustrated in FIG. 8, the potted coil is installed onto a permanent support structure 58. In the illustrated example, permanent support structure 58 is a dual support structure including first and second support structure segments 60 and 62 partitioned by a central plate 64. As shown in FIG. 8, a first potted coil 66 may be slid onto support structure segment 60 and positioned against a first face of central plate 64, and a second potted coil 68 may be slid onto support structure segment 62 and positioned against a second, opposing face of central plate 64. Lastly, as shown in FIG. 9, a first end plate 70 may be installed onto support structure segment 60 and positioned against potted coil 66 to capture coil 66 between end plate 70 and central plate 64; and a second end plate 72 may be installed onto support structure segment 62 and positioned against potted coil 68 to retain coil 68 between end plate 72 and central plate 64. End plates 70 and 72 are preferably decoupled from (not bonded to) dual permanent support structure 58, but may be keyed to prevent rotation with respect support structure 58.

In the above-described manner, a high temperature electromagnetic coil assembly can be produced having potted coils (e.g., coils 66 and 68 shown in FIGS. 8 and 9) mechanically decoupled from the coil assembly package, which reduces thermal and mechanical stresses exerted on the potted coils during operation of the high temperature electromagnetic coil assembly and allows for a greater mismatch in coefficients of thermal expansion between the potted coils and the material from which the support structure is fabricated. In addition, by first winding the coils around a temporary support structure (e.g., support structure 54 shown in FIG. 6), sub-assembly testing can be performed prior to final assembly thereby reducing scrap and rework requirements. In the case of linear variable differential transformers, the above-described exemplary method also enables the secondary coils to be mechanically decoupled from primary coils to further reduce stress and potential rework. Finally, as an additional advantage, the above-described method enables curing of the wet-state, HTE ceramic material prior to installation on the permanent support structure thus allowing the permanent support structure to avoid exposure to thermal cycling.

The foregoing has thus provided embodiments of methods for producing electromagnetic coil assemblies suitable for usage within high temperature operating environments characterized by temperatures exceeding the threshold at which organic materials breakdown and decompose (approximately 260° C.). The above-described electromagnetic coil assemblies are consequently well-suited for usage in high temperature coiled-wire devices, such as those utilized in avionic applications. As a point of emphasis, embodiments of the electromagnetic coil assembly can be employed in any coiled-wire device exposed to operating temperatures exceeding approximately 260° C. However, by way of non-limiting example, embodiments of the high temperature electromagnetic coil assembly are especially well-suited for usage within actuators (e.g., solenoids) and position sensors (e.g., linear variable differential transformers and three wire position sensors) deployed onboard aircraft. To further emphasize this point, two exemplary coiled-wire devices employing high temperature electromagnetic coil assemblies produced utilizing the above-described method will now be described in conjunction with FIGS. 10-12.

Figure 10:
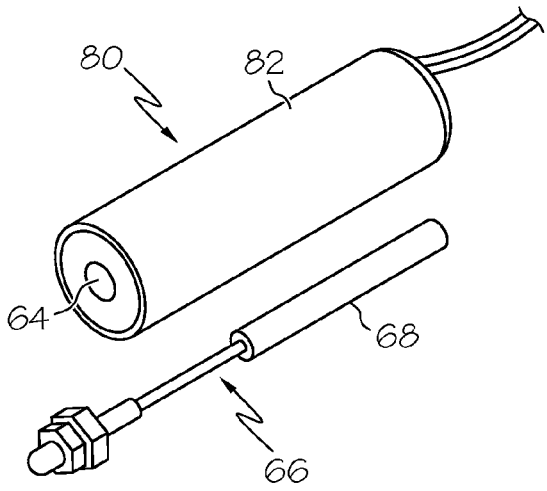
FIGS. 10 and 11 are isometric and simplified cross-sectional views, respectively, of an exemplary linear variable differential transducer including a plurality of high temperature electromagnetic coil assemblies, which may be produced in accordance with exemplary method shown in FIG. 1.
Figure 11:
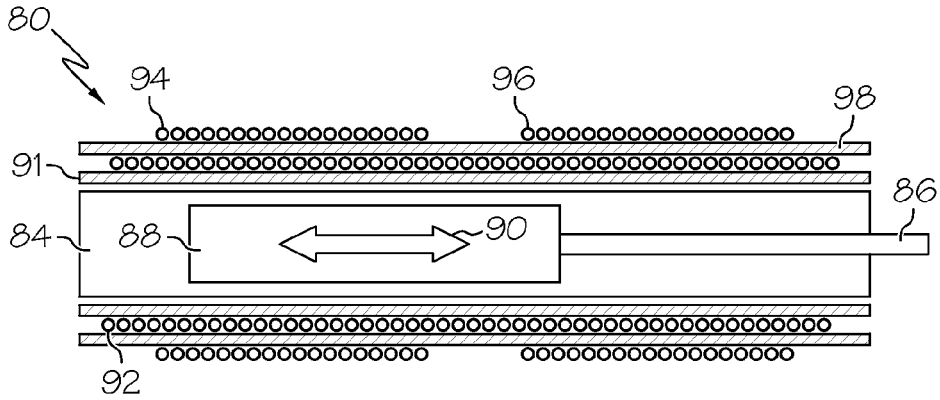

FIGS. 10 and 11 are isometric and simplified cross-sectional views of an exemplary linear variable differential transducer ("LVDT") 80 including a plurality of high temperature electromagnetic coil assemblies produced in accordance with above-described exemplary method 10 (FIG. 1). Referring collectively to FIGS. 10 and 11, LVDT 80 includes two main components: (i) a stationary housing 82 having an axial bore 84 formed therein, and (ii) a rod 86 having a magnetically permeable core 88 affixed to one end thereof. Magnetically permeable core 88 may be formed from a nickel-iron composite, titanium, or other such material having a relatively high magnetic permeability. A number of electromagnetic coil assemblies are disposed within housing 82. For example, and with reference to FIG. 10, a central or primary electromagnetic coil assembly 92 (only the winding of which is shown in FIGS. 10 and 11 for clarity) may be formed around inner annular wall 91 of housing 82; e.g., coil assembly 92 may be formed around inner annual wall 91 of housing 82 in the manner described above in conjunction with FIGS. 1-4 (i.e., inner annular wall 91 may serve as the coil support structure), or coil assembly 92 may be formed around a temporary support structure, removed, and subsequently inserted over inner annular wall 92 of housing 91 in a manner similar to that described above in conjunction with FIGS. 7-9. First and second secondary electromagnetic coil assemblies 94 and 96 are further disposed around an outer portion of housing 82 (again only the windings of coil assemblies 94 and 96 are shown in FIGS. 10 and 11 for clarity). In one specific implementation, primary electromagnetic coil assembly 92 contains a 350-turn coil comprising a single layer of anodized aluminum wire, and electromagnetic coil assemblies 94 and 96 each contain a 125-turn coil comprising three layers of anodized aluminum wire. Electromagnetic coil assemblies 94 and 96 may generally circumscribe substantially opposing portions of electromagnetic coil assembly 92. As shown in FIG. 11, an insulative body 98 (e.g., ceramic felt) may be disposed between secondary electromagnetic coil assemblies 94 and 96 and primary electromagnetic coil assembly 92.

Opposite core 88, rod 86 is fixedly coupled to a translating component, such as a piston valve element (not shown), and translates therewith relative to stationary housing 82. As rod 86 translates in this manner, magnetically permeable core 88 slides axially within bore 84 (indicated in FIG. 11 by double-headed arrow 90). When an alternating current is applied to the winding of electromagnetic coil assembly 92 (commonly referred to as the "primary excitation"), a differential AC voltage is induced in one or both of the windings of electromagnetic coil assemblies 94 and 96. The differential AC voltage between the windings of electromagnetic coil assemblies 94 and 96 varies in relation to the axial movement of magnetically permeable core 88 within axial bore 84. During operation of LVDT 80, electronic circuitry (not shown) associated within LVDT 80 converts the AC output voltage to a suitable current (e.g., high level DC voltage) indicative of the translational position of core 88 within bore 84. The DC voltage may be monitored by a controller (also not shown) to determine the translation position of core 88 and, therefore, the translational position of the movable element (e.g., piston valve element) fixedly coupled to rod 86. Notably, due in part to the utilization of high temperature electromagnetic coil assemblies 92, 94, and 96, LVDT 80 is well-suited for use in high temperature environments, such as those commonly encountered in avionics applications.

Figure 12:
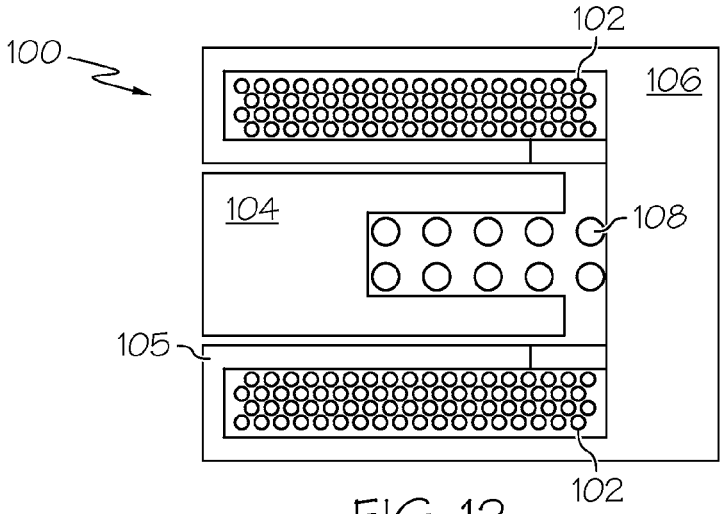
FIG. 12 is a simplified cross-sectional view of an exemplary solenoid including a high temperature electromagnetic coil assembly, which may be produced in accordance with exemplary method shown in FIG. 1.

FIG. 12 is a simplified cross-sectional view of a second exemplary electromagnetic device, namely, a solenoid 100 including a high temperature electromagnetic coil assembly 102 of the type described above (only the windings of which are shown in FIG. 12 for clarity). As was the case previously, a core 104 is disposed within the axial bore of a tubular support structure 105 around which the potted coil of electromagnetic coil assembly 102 is formed. Core 104 is able to translate relative to electromagnetic coil assembly 102 between an extended position and a retracted position (shown). Electromagnetic coil assembly 102 is mounted within a stationary housing 106, and a spring 108 is compressed between an inner wall of housing 106 and an end portion of core 104. Spring 108 thus biases core 104 toward the extended position. When electromagnetic coil assembly 102 is de-energized, spring 108 expands and core 104 moves into the extended position. However, when electromagnetic coil assembly 102 is energized, the magnetic field generated thereby attracts core 104 toward the retracted position (shown). As a result, core 104 moves into the refracted position, and spring 108 is further compressed between core 104 and housing 106. Due in part to the utilization of electromagnetic coil assembly 102, solenoid 100 is well-suited for usage within avionic applications and other high temperature applications.

Non-Limiting Examples of Reduction to Practice and Testing

The following testing examples are set-forth to further illustrate non-limiting embodiments of the high temperature electromagnetic coil assembly and methods for the fabrication thereof. The following testing examples are provided for illustrative purposes only and are not intended as an undue limitation on the broad scope of the invention, as set-forth in the appended claims.

A support structure was etched and anodized to create an electrically insulating layer. Utilizing a rotating apparatus, the anodized support structure was then rotated slowly while a thin layer of a water-based cement was applied via a brush. The cement was allowed to air dry. Utilizing a wire winding machine, anodized aluminum wire was wound around the support structure. The water-based cement was continuously applied via the brush just ahead of the location where the wire was laid down. Ample cement was applied to ensure filling of the spaces between winding layers and adjacent wires. The entire structure was then subjected to the cement's curing cycle up to the expected operating temperature of the final device. Anodized aluminum wire from OXINAL® was wound on tubes coated with either wet or dried cement. An overcoat of the cement was also applied.

Three candidate cements were tested for usage as the high thermal expansion ceramic material: (i) a water-based cement bearing product no. "33S" and commercially available from the SAUEREISEN® Cements Company, Inc., headquartered in Pittsburgh, Pa. ("SAUEREISEN®"); (ii) a two-part, non-water based cement bearing product name "Aluseal 2L" and also commercially available from SAUEREISEN®; and (iii) a water-based cement bearing product no. "538N" and commercially available from Aremco™ Products, Inc., headquartered in Valley Cottage, N.Y. Electrical properties (i.e., resistance of the wound wire to detect shorting between windings, resistance between the wire and tube, and the breakdown voltage) were measured for each sample. The samples were also subjected to thermal cycling between −20° C. and 150° C., as well as to room temperatures and elevated temperatures of approximately 400° C. The SAUEREISEN® 33S cement proved to be the best performer, and was thus chosen as the cement to use for further testing. Without being bound by theory, the SAUEREISEN® 33S cement was believed to outperform the other tested cements due, in substantially part, to its relatively high coefficient of thermal expansion (approximately 17 ppm per ° C.).

After the optimum cement was chosen for the application, the cement and wire were combined with a bobbin to make a solenoid. Although the bobbin has two halves for redundancy, only one side was used for the initial trial. The bobbin support structure and walls were coated with a glass and fired. The anodized aluminum wire was then wrapped around the support structure, with cement being continuously applied, until the winding diameter had reached the top of the bobbin walls or a pre-set number of layer/windings was achieved. The structure was then cured. The structure was placed in an air furnace, electrical connections made to the two ends of the wound wire, and a thermocouple inserted into the support structure of the bobbin. A constant current of 0.3 A was applied, first at room temperature, and then the furnace temperature was increased to 320° C. The resultant voltage and bobbin support structure temperature were recorded. Testing demonstrated that thermal and electrical stability was achieved relatively quickly. Thermal and electrical stability remained constant during continuous thermal and electrical exposure of approximately 3000 hours. While the ambient temperature was 350° C., the bobbin temperature was approximately 358° C. due to the power produced from the applied current.

Further testing was performed utilizing a second dual support structure bobbin having two identically-wound halves. The bobbin was electrically connected inside a furnace in the same manner as the single bobbin sample, with each half having its own current supply and support structure thermocouple. As both support structures of the dual support structure bobbin were simultaneously energized, the power output and bobbin temperature was expectedly higher. In particular, the bobbin temperature of each half was recorded at approximately 410° C. When energizing only one side of the dual support structure bobbin over a given period of time, the required operating conditions for the tested device were approximately 320° C. and 0.2 A. As was the case previously, stability was reached rather quickly, and both halves have shown excellent stability and similarity over the duration of a relatively prolonged trial period (approximately 3000 hours).

The foregoing has thus provided embodiments of electromagnetic coil assemblies suitable for usage within high temperature coiled-wire devices of the type utilized within avionic applications and other high temperature applications. As noted above, such high temperature coiled-wire devices include, but are not limited to, solenoids, linear variable differential transformers, and three wire position sensors. Notably, embodiments of the above-described high temperature electromagnetic coil assembly are capable of reliable and continual operation when subjected to temperatures in excess of 260° C. Furthermore, due in substantial part to the usage of anodized aluminum wire, embodiments of the above-described high temperature electromagnetic coil assembly are relatively inexpensive to produce, compact, and lightweight. The foregoing has also described several exemplary embodiments of a method for fabricating such a high temperature electromagnetic coil assembly.

In general, the above-described embodiments of the high temperature electromagnetic coil assembly fabrication method include the steps of: (i) coating an anodized aluminum wire with a high thermal expansion ceramic material, (ii) coiling the coated anodized aluminum wire around a support structure, and (iii) curing the high thermal expansion ceramic coating after coiling to produce an electrically insulative, high thermal expansion ceramic body in which the coiled anodized aluminum wire is embedded. In preferred embodiments, the step of coating is carried-out utilizing a wet winding process wherein the anodized aluminum wire is wound around a support structure while the wire is covered with a wet-state or viscous coating (commonly referred to as a "green state" coating), which contains or is comprised of the high thermal expansion ceramic material. The wet winding process does not necessarily entail application of the wet-state, high thermal expansion ceramic material to the anodized aluminum wire during the winding process. However, in still more preferred embodiments, the step of coating is carried-out utilizing a wet winding process wherein the anodized aluminum wire is wound around a support structure while the high thermal ceramic material is simultaneously or concurrently applied to the wire as a, for example, a pre-cure, wet-state cement or a low melt glass particles carried by a paste, slurry, or other such solution, which can be conveniently applied to the wire by brushing, spraying, or similar technique, as previously described.

The foregoing has also disclosed a method for fabricating a high temperature electromagnetic coil assembly that includes the steps of: (i) applying a wet-state, high thermal expansion ceramic material over a coiled anodized aluminum wire; and (ii) curing the wet-state, high thermal expansion ceramic material to produce an electrically-insulative, high thermal expansion ceramic body in which the coiled anodized aluminum wire is embedded. The wet-state, high thermal expansion ceramic material is selected to produced, when cured, an electrically-insulative, high thermal expansion ceramic body having a coefficient of thermal expansion substantially matched to the coefficient of thermal expansion of the coiled anodized aluminum wire. As utilized herein, the phrase "substantially matched" denotes that a first coefficient of thermal expansion (e.g., the coefficient of thermal expansion of the ceramic body) differs from a second coefficient of thermal expansion (e.g., the coefficient of thermal expansion of the anodized aluminum wire) by no more than 7 ppm per ° C. Advantageously, by forming the high thermal expansion ceramic body from a material having a coefficient of thermal expansion substantially matched to that of the anodized aluminum wire, thermal mismatch between the ceramic body and the anodized aluminum wire is minimized resulting in a significant reduction in the mechanical stress exerted on the ceramic body and the wire through thermal cycling of the high temperature electromagnetic coil assembly.

While multiple exemplary embodiments have been presented in the foregoing Detailed Description, it should be appreciated that a vast number of variations exist. It should also be appreciated that the exemplary embodiment or exemplary embodiments are only examples, and are not intended to limit the scope, applicability, or configuration of the invention in any way. Rather, the foregoing Detailed Description will provide those skilled in the art with a convenient road map for implementing an exemplary embodiment of the invention. It being understood that various changes may be made in the function and arrangement of elements described in an exemplary embodiment without departing from the scope of the invention as set-forth in the appended Claims.

What is claimed is:

1. A method for fabricating a high temperature electromagnetic coil assembly, comprising the steps of:

applying a high thermal expansion ceramic coating over an anodized aluminum wire that produces, when cured, an electrically-insulative, high thermal expansion ceramic body having a coefficient of thermal expansion greater than 10 parts per million per degree Celsius and less than the coefficient of thermal expansion of the anodized aluminum wire;

coiling the coated anodized aluminum wire around the support structure prior to, during, or after application of the high thermal expansion ceramic coating; and curing the high thermal expansion ceramic coating after coiling to produce an electrically insulative, high thermal expansion ceramic body in which the coiled anodized aluminum wire is embedded.

2. The method of claim 1 wherein the step of applying comprises applying a high thermal expansion ceramic coating over the anodized aluminum wire that produces, when cured, an electrically-insulative, high thermal expansion ceramic body having a coefficient of thermal expansion between about 16 and about 23 parts per million per degree Celsius.

3. The method of claim 1 wherein the high thermal expansion ceramic coating is applied over the anodized aluminum wire, while the anodized aluminum wire is coiled around the support structure utilizing a wet winding process.

4. The method of claim 1 further comprising the step of providing a temporary support structure, wherein the step of coiling comprises coiling the coated anodized aluminum wire around the temporary support structure, and wherein the step of curing comprises curing the high thermal expansion ceramic coating after coiling to produce potted ceramic body containing the coiled anodized aluminum wire.

5. The method of claim 4 further comprising:

removing the potted ceramic body from the temporary support structure; and affixing the potted ceramic body on a permanent support structure.

6. The method of claim 4 wherein the support structure comprises a tubular support structure having an axial bore therein, and wherein the method further comprises the step of slidably disposing a magnetically-permeable core within the axial bore to produce a coiled-wire device selected from the group consisting of a solenoid and a linear variable differential transformer.

7. A method for fabricating a high temperature electromagnetic coil assembly, comprising the steps of:

wet winding an anodized aluminum wire around a support structure by coiling the anodized aluminum wire around the support structure while applying a wet-state, inorganic cement over the anodized aluminum wire; and curing the wet-state, inorganic cement applied over the anodized aluminum wire after wet winding to produce an electrically insulative, high thermal expansion ceramic body in which the coiled anodized aluminum wire is embedded.

8. The method of claim 7 wherein the step of curing comprises curing the wet-state, inorganic cement at a temperature less than the melting point of the anodized aluminum wire to produce an electrically-insulative, high thermal expansion cement body in which the coiled anodized aluminum wire is embedded.

9. The method of claim 8 further comprising the step of applying a sealant over an outer surface of the electrically-insulative, high thermal expansion cement body.

10. The method of claim 9 wherein the sealant is selected from the group consisting of a low melt glass and a water-glass.

11. The method of claim 9 wherein the step applying a sealant comprises applying a ceramic material over an outer surface of the electrically-insulative, high thermal expansion cement body utilizing a sol-gel coating process.

12. The method of claim 8 further comprising the step of sealing the electrically-insulative, high thermal expansion cement body within a hermetic canister.

13. A method for fabricating a high temperature electromagnetic coil assembly, comprising the steps of:

wet winding an anodized aluminum wire around a support structure by coiling the anodized aluminum wire around the support structure while applying a paste over the anodized aluminum wire, the paste containing a low melt glass having a melting point less than the melting point of the anodized aluminum wire; and curing the paste applied over the anodized aluminum wire after wet winding to produce an electrically insulative, high thermal expansion ceramic body in which the coiled anodized aluminum wire is embedded.

14. The method of claim 13 wherein the paste further contains a filler material having a melting point exceeding the melting point of the low melt glass.

15. The method of claim 14 wherein the filler material comprises a plurality of platelet-shaped particles.

16. The method of claim 13 wherein the low melt glass comprises leaded boron silicate.

* * * * *